United States Patent [19]

Hash

[11] 4,250,696

[45] Feb. 17, 1981

[54] BRUSH AND MESQUITE CUTTER

[76] Inventor: Jack J. Hash, Box 489, Crosbyton, Tex. 79322

[21] Appl. No.: 26,734

[22] Filed: Apr. 3, 1979

[51] Int. Cl.[3] ..... A01D 14/04

[52] U.S. Cl. ..... 56/14.7; 56/295; 56/16.2

[58] Field of Search ..... 56/14.7, 295, 16.2; 37/108 R

[56] References Cited

U.S. PATENT DOCUMENTS

| | | | |
|---|---|---|---|
| Re. 24,811 | 4/1960 | Murphy et al. | 56/14.7 |
| 2,475,716 | 7/1949 | Nabors | 56/17.2 |
| 3,087,296 | 4/1963 | Cowles | 56/10.9 |
| 3,777,822 | 12/1973 | Stedman et al. | 37/108 R |

*Primary Examiner*—Robert A. Hafer

*Attorney, Agent, or Firm*—Clarence A. O'Brien; Harvey B. Jacobson

[57] ABSTRACT

A road grader of the type including a tiltable and vertically adjustable frame is utilized to dependingly support a heavy duty multibladed horizontal rotary cutter head. The frame supports a prime mover drivingly connected to the rotary cutter head and the latter includes a horizontal disc from which elongated blades are supported. The elongated blades include base and free ends and the base ends of the blades are pivotally attached to spaced peripheral portions of the disc for oscillation relative thereto about upstanding axes. The rotary cutter head is disposed between the front steerable and rear driving wheels of the road grader and the blade frame of the grader is provided with a rearwardly opening semi-truncated cone-shaped shield within whose lower periphery the forward outer marginal portion of the disc is received and beneath whose lower periphery the free ends of the blades carried by the forward half of the rotary disc project.

5 Claims, 7 Drawing Figures

34
36
28
26
16
16
24
56
52
58
14
18
32
30
50
54
70
70
66
68
60
74
62
64
78
80
82

10
24
56
58
18
52
54
70
86
88
60
68
92
66
80
82
78

BRUSH AND MESQUITE CUTTER

BACKGROUND OF THE INVENTION

Grazing land in the southwest of the United States often has considerable amounts of scrub trees and mesquite growing thereon and these scrub trees and mesquite occasionally must be cleared from the grazing lands in order to realize full benefit thereof. However, southwest grazing lands are extremely extensive in area and considerable time must be spent by conventional methods to remove scrub trees and mesquite even when the grazing lands are only sparcely covered by trees and mesquite.

In the past, scrub trees and mesquite have been cleared from grazing lands through the utilization of root plows, but root plows often disturb the grass roots and create weed problems requiring reseeding of grass and the land to lay idle for three or four years. Of course, the grass of the southwest grasslands is allowed to flourish when mesquite and scrub trees can be eliminated with the result that the grasslands may be used to graze larger cattle herds.

Accordingly, a need exists for mechanized structure by which mesquite and scrub trees may be removed from large areas of grasslands without adversely affecting the grass thereon and in a minimum of time and with a minimum of expenditure of funds.

Although various forms of shrub cutters including large capacity rotary cutter heads and other devices including some of the general structural features of the instant invention have been heretofore provided, these scrub cutters and other structures have not been specifically designed for heavy duty use in clearing scrub trees and mesquite from grasslands in an efficient manner. Examples of some of the previously known structures referred to above are disclosed in U.S. Pat. Nos. 2,197,549, 2,475,716, 3,087,296 and 3,654,750.

BRIEF DESCRIPTION OF THE INVENTION

A road grader of the type including front steerable wheels and rear driving wheels as well as a tiltable and vertically adjustable grader blade frame supported between the front and rear wheels of the grader is provided and a forwardly shielded rotary cutter head is dependingly journaled from the blade frame. In addition, a prime mover is supported from the blade frame and is drivingly coupled to the rotary head. The shield comprises a rearwardly opening hollow and truncated conical shield beneath whose lower marginal edges pivotally mounted radial blades of the rotary cutter head project. The shield performs an important function in that scrub trees and mesquite must have the outer branches thereof lifted upwardly in order to expose the lower portions of the trunks thereof for cutting.

The main object of this invention is to provide a scrub tree, brush and mesquite cutter which may be utilized to rapidly and efficiently clear grasslands free of brush, scrub trees and mesquite.

Another object of this invention, in accordance with the immediately preceding object, is to provide an apparatus which may utilize a conventional powered mobile frame effectively for the purpose of supporting a rotary cutter head in an operative manner so as to be capable of cutting brush, scrub trees and mesquite without adversely affecting the growth of grass on the grasslands being cleared.

Still another object of this invention is to provide a scrub tree, brush and mesquite cutter which will be capable of traversing rough ground surfaces between adjacent sections of grazing land to be cleared.

A final object of this invention to be specifically enumerated herein is to provide a brush, scrub tree and mesquite cutter in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
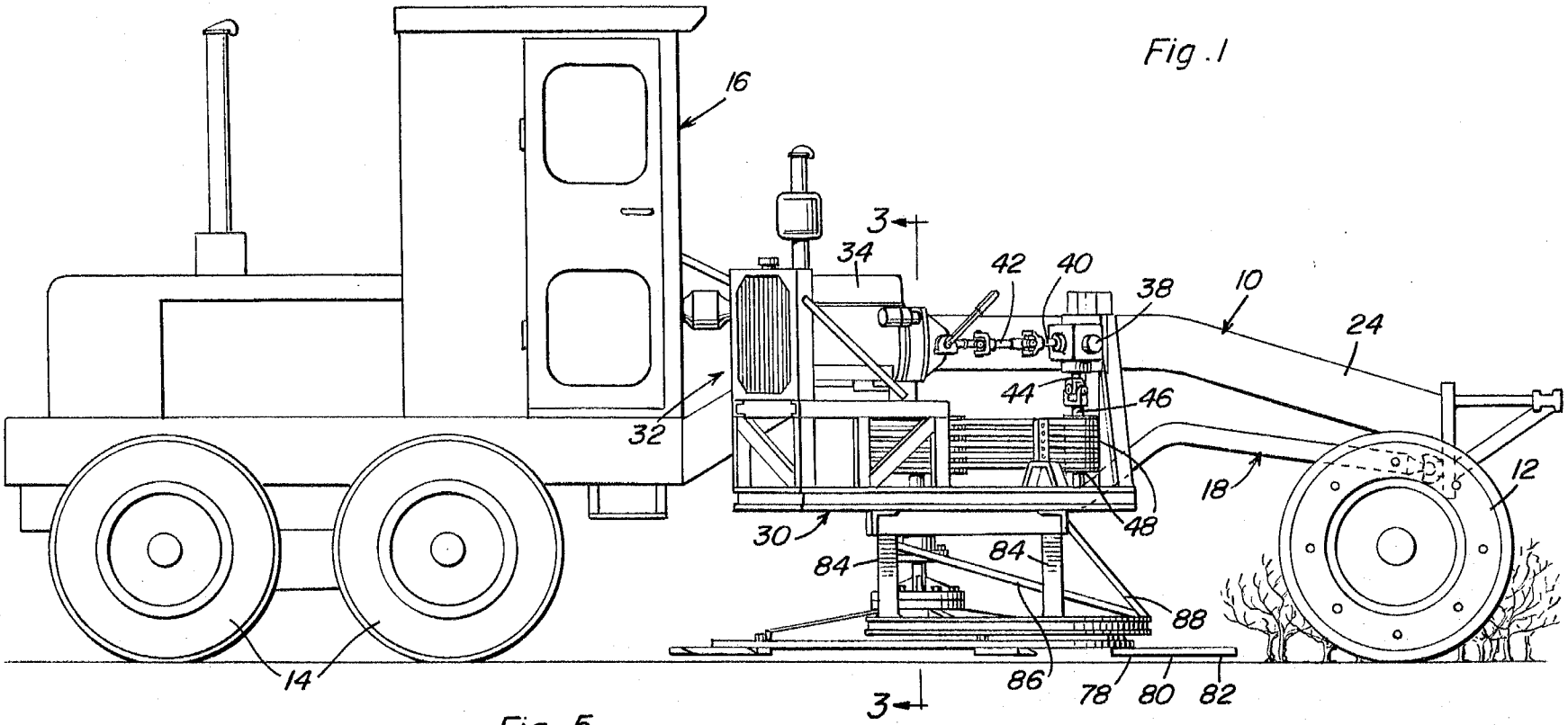
FIG. 1 is a side elevational view of a conventional form of road grader which has been modified in accordance with the present invention for the purpose of cutting brush, scrub trees and mesquite.
Figure 6:
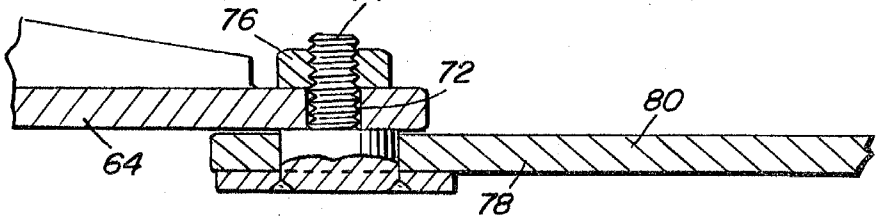
FIG. 6 is a fragmentary vertical sectional view taken substantially upon the plane indicated by the section line 6—6 of FIG. 2.
Figure 5:
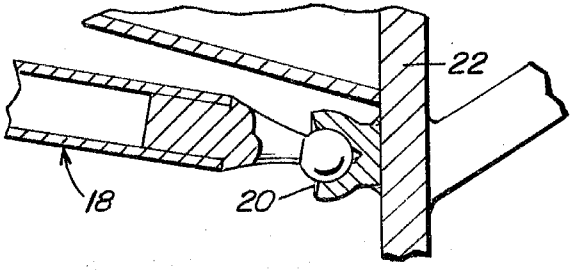
FIG. 5 is an enlarged fragmentary vertical sectional view taken substantially upon the plane indicated by the section line 5—5 of FIG. 2.
Figure 2:
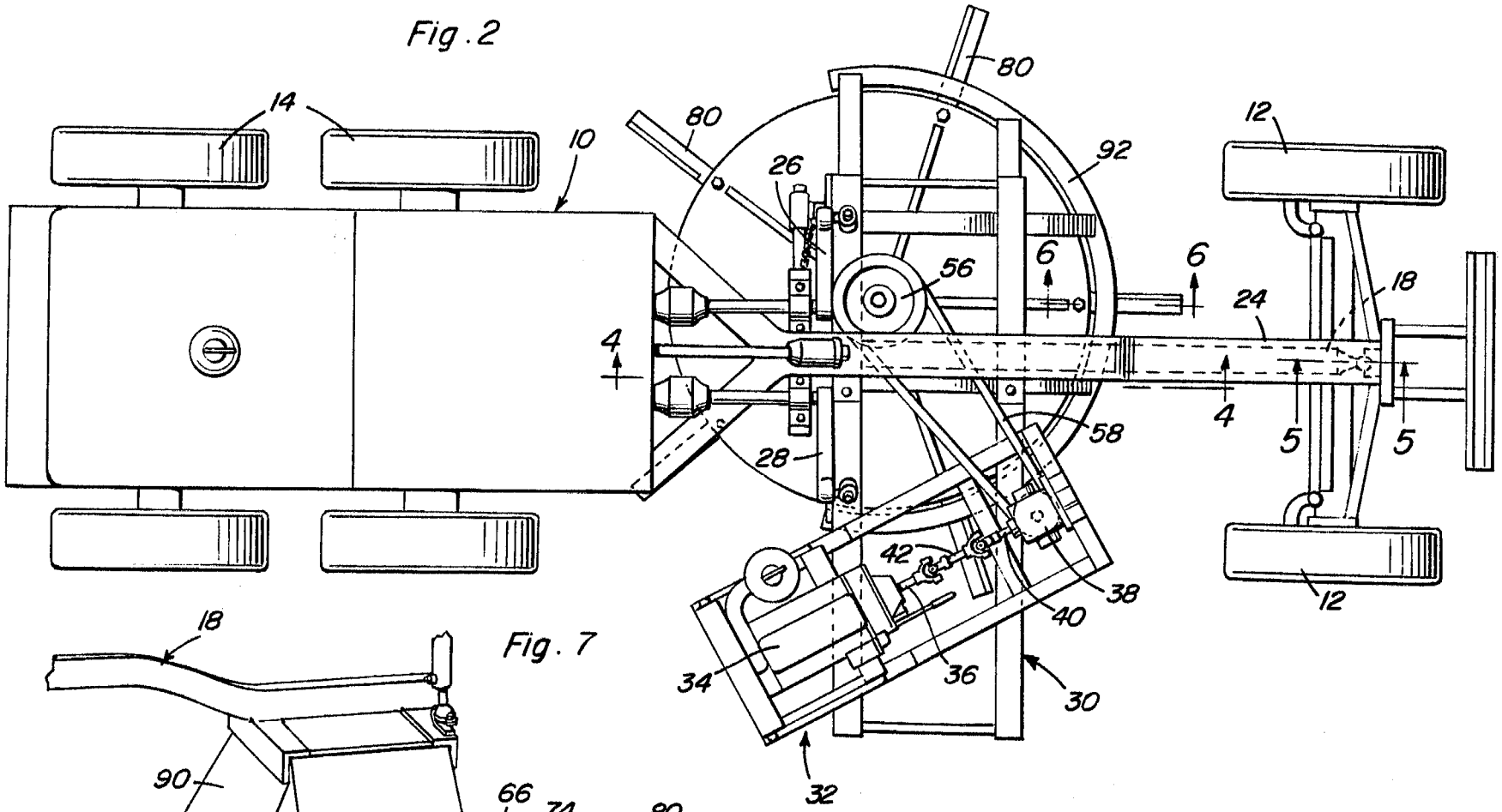
FIG. 2 is a top plan view of the assemblage illustrated in FIG. 1.
Figure 7:
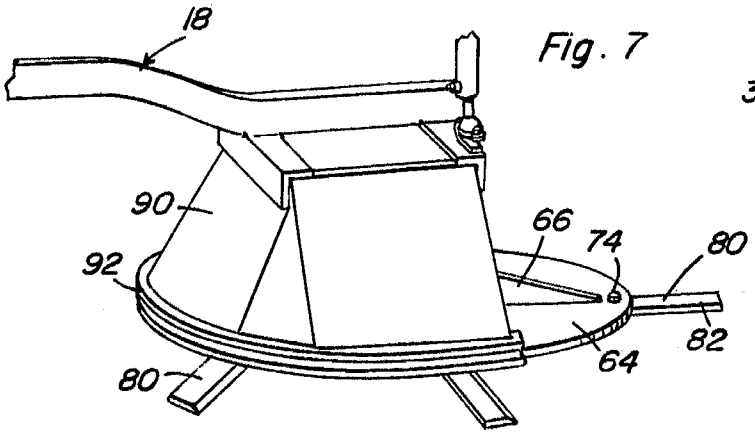
FIG. 7 is a perspective view of the rotary cutter head and adjacent shield and supportive frame portions, the shield being omitted from FIGS. 1–4.
Figure 3:
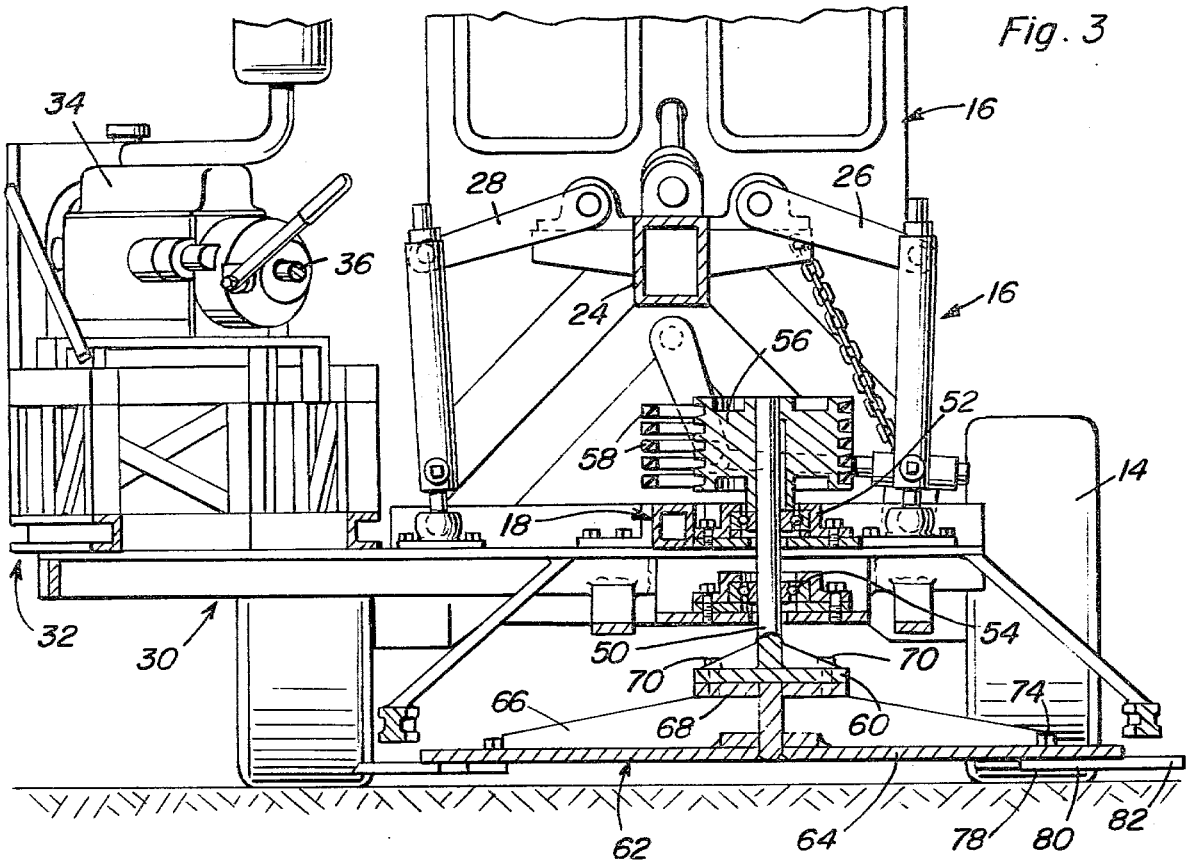
FIG. 3 is an enlarged fragmentary transverse vertical sectional view taken substantially upon the plane indicated by the section line 3—3 of FIG. 1.
Figure 4:
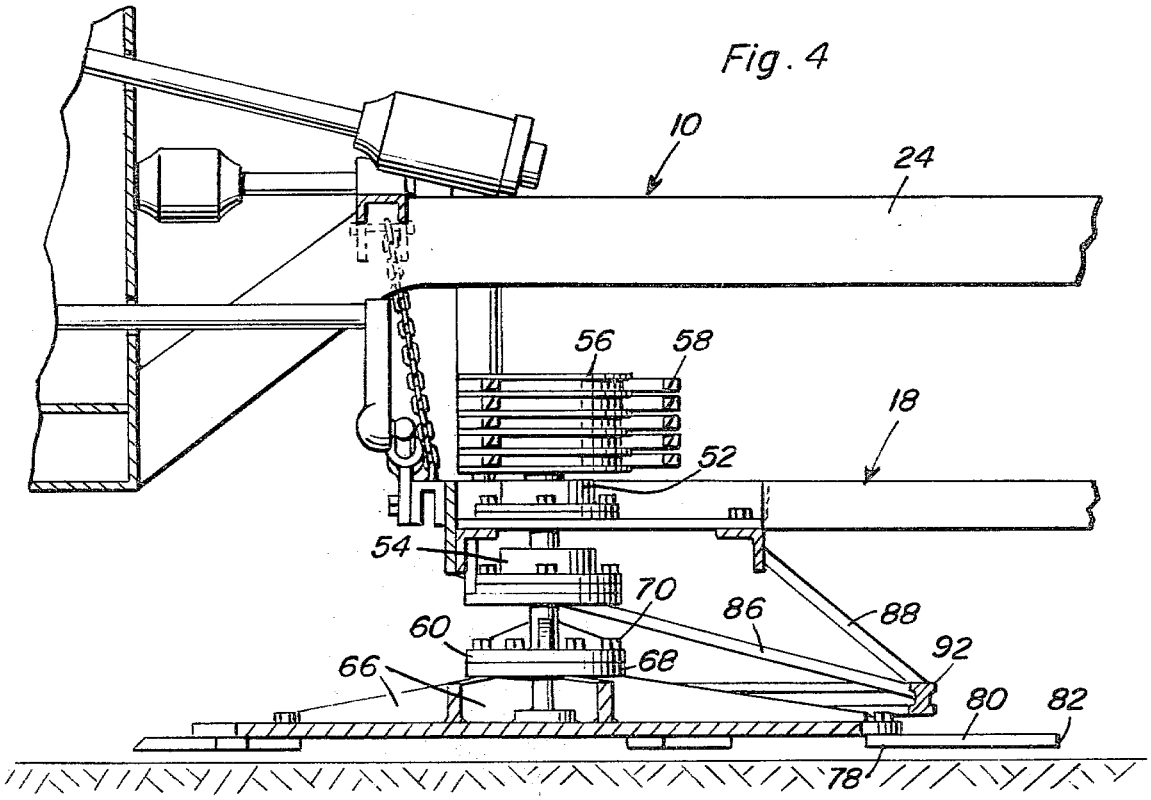
FIG. 4 is an enlarged fragmentary longitudinal vertical sectional view taken substantially upon the plane indicated by the section line 4—4 of FIG. 2.

Referring now more specifically to the drawings, the numeral 10 generally designates a conventional form of road grader including front steerable wheels 12 and rear driving wheels 14. The grader 10 further includes a cab enclosure referred to in general by the reference numeral 16 for the operator of the grader 10 and the grader 10 also includes a grader blade support frame referred to in general by the reference numeral 18 from which a grader blade is generally supported. However, for the purpose of the instant invention, the grader blade assembly has been removed from the frame 18, the forward end of the frame 18 being universally supported as at 20 from the forward end 22 of the main frame 24 of the grader 10 and the rear end portion of the frame 18 being vertically adjustable as well as selectively inclinable by lift arms 26 and 28 supported from opposite sides of the main frame 24.

The frame 18 includes a transverse frame assembly 30 supported therefrom upon one side of which a modular power source referred to in general by the reference numeral 32 is supported. The power source 32 includes an internal combustion engine 34 having a rotatable output shaft 36 and a right angle drive transmission 38 is also included in the power source 32 and includes a rotary input shaft 40 driven from the shaft 36 by means of a drive shaft assembly 42. The transmission 38 includes a rotary output shaft 44 and the output shaft 44 drives a journaled vertical power shaft 46 including a multi-grooved pulley 48 thereon.

The transverse frame assembly 30 journals an upstanding driven shaft 50 from upper and lower bearing assemblies 52 and 54 supported from the assembly 30 and the upper end of the shaft 50 projects above the assembly 30 and includes a multi-grooved pulley 56 mounted thereon. A plurality of endless belts 58 drivingly couple the pulley 48 to the pulley 56 and the lower end of the shaft 50 projects below the transverse frame assembly 30 in depending fashion and includes a radially enlarged mounting plate 60 thereon.

A rotary cutter head referred to in general by the reference numeral 62 is provided and includes a circular disc 64 provided with radial buttress-type reinforcing members 66 on its upper surface. The reinforcing members 66 have a mounting plate 68 mounted atop the radial innermost ends thereof and the mounting plate 68 is secured to the mounting plate 60 through the utilization of suitable fasteners 70.

The outer periphery of the disc 64 is provided with circumferentially spaced vertical bores 72 and headed pivot fasteners 74 are secured upwardly through the bores 72 by threaded nuts 76 and oscillatably support the base ends 78 of elongated cutter blades 80 including outer free ends 82 from the periphery of the disc 64.

The frame 30 includes downwardly and outwardly divergent brace members 84, 86 and 88 supported therefrom and the lower ends of the brace members 84, 86 and 88 are spaced about the forward half of the circular plan area of the disc 64. The brace members 84, 86 and 88 support a hollow one-half generally truncated cone-shaped shield 90 therefrom whose outer surfaces are downwardly and outwardly inclined and terminate at a generally semi-circular structural member 92 to which the lower ends of the brace members 84, 86 and 88 are anchored. The lower marginal portion of the shield 90 and the structural member 92 enclose the forward marginal portions of the disc 64 thereunder and the free end portions 82 of the blades 80 project radially outwardly from beneath the structural member 92.

In operation, the engine 34 is operated to rotate the rotary head 62 at approximately 400 rmp and the blades 80 weight between 35 and 40 pounds.

Further, the disc 64 is approximately 8 feet in diameter and thus it may be seen that the inertia of the blades 80 spinning at 400 rpm is considerable. The blades are effective to cut ground stumps up to 10 inches in diameter and thus it may be seen that substantially all scrub trees, brush and mesquite may be cleared through the utilization of the brush cutter comprising the modified grader 10. The front wheels 12 of the grader have their tread portions equipped with an armor coating (not shown) to protect the front wheels from damage due to flying debris. Of course, the frame 18 may be raised and lowered and also tilted according to the terrain over which the grader 10 is moving and thus the blades 80 may be maintained close to the ground. It is again stressed that the provision of the shield 90 is most important in that it serves to lift the outer limb portions of the scrub trees, brush and mesquite in order to expose the root portions for cutting by the blades 80. Further, the shield also serves to protect the lower portions of the drive train for the rotary head 62.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a road grader of the type including front steerable wheels and rear driving wheels as well as a blade support frame mounted between the front and rear wheels and vertically adjustable and also tiltable about a front to rear extending axis, a brush and mesquite cutter supported from said frame, said cutter including a multi-bladed horizontal rotary cutter head journaled from said frame for rotation about an upstanding axis, motor means drivingly connected to said cutter head for rotation thereof, said rotary head including a horizontal disc concentric with said axis and a plurality of elongated blade members including base and free ends, means pivotally attaching said base ends of said blades to spaced peripheral portions of said disc with the free ends of said blades projecting outwardly of said disc, said rotary head being dependingly supported from said frame, said frame including a hollow truncated semi-conical shield structure enclosing the forward half of said disc from above, the free ends of said blade members projecting outwardly beyond the lower marginal portions of said shield structure, said frame including a semi-circular structural member disposed about and slightly above the forward marginal portion of said disc, said frame including downwardly divergent brace members spaced about said axis and from whose lower ends said structural member is supported, said shield enclosing said brace members and the lower marginal portion of said shield being anchored relative to said structural member.

2. The combination of claim 1 wherein said motor means is supported from said frame.

3. The combination of claim 1 wherein said motor means includes a prime mover having a horizontal rotary output shaft, and drive train means drivingly connecting said output shaft to said rotary cutter head, said drive train means including a right angle gear drive transmission.

4. In combination with a vehicle of the type including front steerable wheels and rear driving wheels as well as a support frame mounted between the front and rear wheels for vertical adjustment relative to said vehicle, a brush and mesquite cutter supported from said frame, said cutter including a multi-bladed horizontal rotary cutter head journaled from said frame for rotation about an upstanding axis, motor means drivingly connected to said cutter head for rotation thereof, said rotary cutter head including a horizontal disc concentric with said axis and a plurality of elongated blade members including base and free ends, means pivotally attaching said base ends of said blades to spaced peripheral portions of said disc with the free ends of said blades projecting outwardly of said disc, said rotary head being dependingly supported from said frame, said frame including a hollow truncated semi-cylindrical shield structure enclosing the forward half of said disc from above, the free ends of said blade members projecting outwardly beyond the lower marginal portions of said shield structure, said frame including a semi-circular structural member disposed about and slightly above the forward marginal portion of said disc, said frame including downwardly divergent frame members spaced about said axis and from whose lower ends said structural member is supported, said shield enclosing said brace members and the lower marginal portion of said shield being anchored relative to said structural member.

5. A motorized mobile chassis, a support frame supported from said chassis, a brush and mesquite cutter supported from said frame, said cutter including a multi-bladed horizontal rotary cutter head journaled from said frame for rotation about an upstanding axis, motor means drivingly connected to said cutter head for rotation thereof, said rotary head including a horizontal disc concentric with said axis and a plurality of elongated blade members including base and free ends, means pivotally attaching said base ends of said blades to spaced peripheral portions of said disc with the free ends of said blades projecting outwardly of said disc, said rotary head including an upstanding rotary shaft concentric with said axis and from whose lower end said disc is supported for rotation therewith, said shaft depending downwardly from said frame, said frame including a hollow truncated semi-cylindrical shield structure enclosing the forward half of said disc from above and the area of the depending portion of said shaft spaced immediately forward of the latter, the free ends of said blade members projecting outwardly beyond the lower marginal portions of said shield structure.

* * * * *